US005694728A

United States Patent [19]

Heath, Jr. et al.

[11] Patent Number: 5,694,728

[45] Date of Patent: Dec. 9, 1997

[54] VINYL SIDING SYSTEM

[76] Inventors: Clifford Stanley Heath, Jr.; Bradley Heath, both of Box 2441 County Rd. 97, Flat Rock, Ala. 35966

[21] Appl. No.: 651,208

[22] Filed: May 22, 1996

[51] Int. Cl.[6] ..... E04D 1/00

[52] U.S. Cl. ..... 52/554; 52/518; 52/529

[58] Field of Search ..... 52/518, 519, 546, 52/554, 555, 529, 233

[56] References Cited

U.S. PATENT DOCUMENTS

| | | | |
|---|---|---|---|
| 4,122,643 | 10/1978 | Hafner | 52/529 X |
| 4,601,135 | 7/1986 | Ellis et al. | 52/529 X |
| 5,181,358 | 1/1993 | Mead | 52/233 |
| 5,586,422 | 12/1996 | Hoffner | 52/546 X |

FOREIGN PATENT DOCUMENTS

| | | | |
|---|---|---|---|
| 679956 | 9/1952 | United Kingdom | 52/529 |
| 1119204 | 7/1968 | United Kingdom | 52/529 |

*Primary Examiner*—Carl D. Friedman
*Assistant Examiner*—Creighton Smith
*Attorney, Agent, or Firm*—Michael I. Kroll

[57] ABSTRACT

A vinyl siding system (12) for the exterior walls of a building (14) which comprises a plurality of panels (16) in which each of the panels (16) has a body portion (18). A structure (20) is for mounting the panels (16) against the exterior walls of the building (14) in horizontal extending rows, so that the panels (16) will be aligned one above another. A facility (22) is for over locking the panels (16) together, when the mounting structure (20) is utilized on the exterior walls of the building (14), so as to keep the panels (16) from coming loose during expansion of the panels (16).

17 Claims, 6 Drawing Sheets

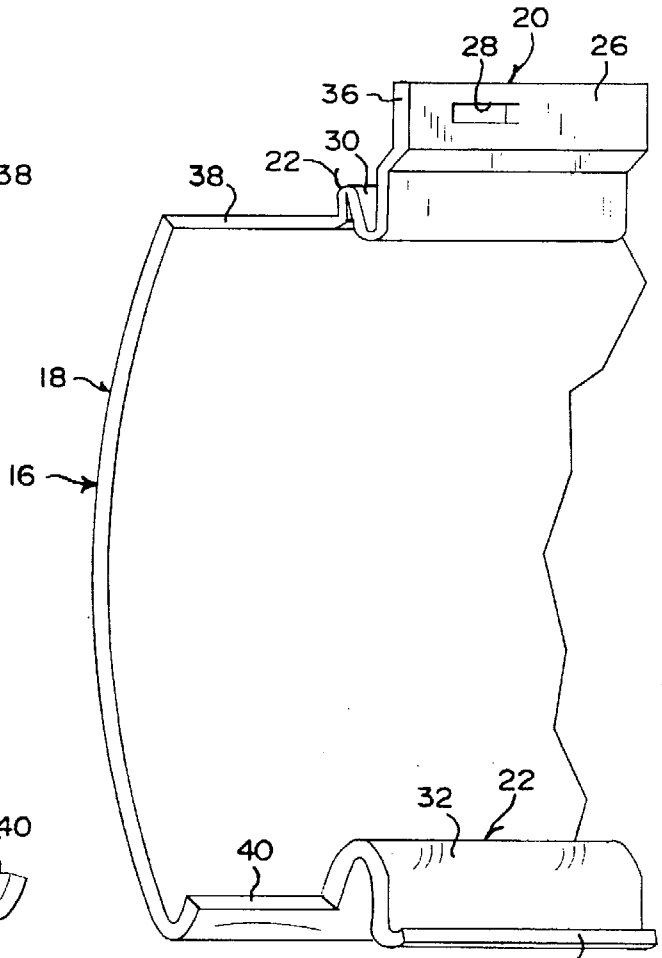
FIG 2D
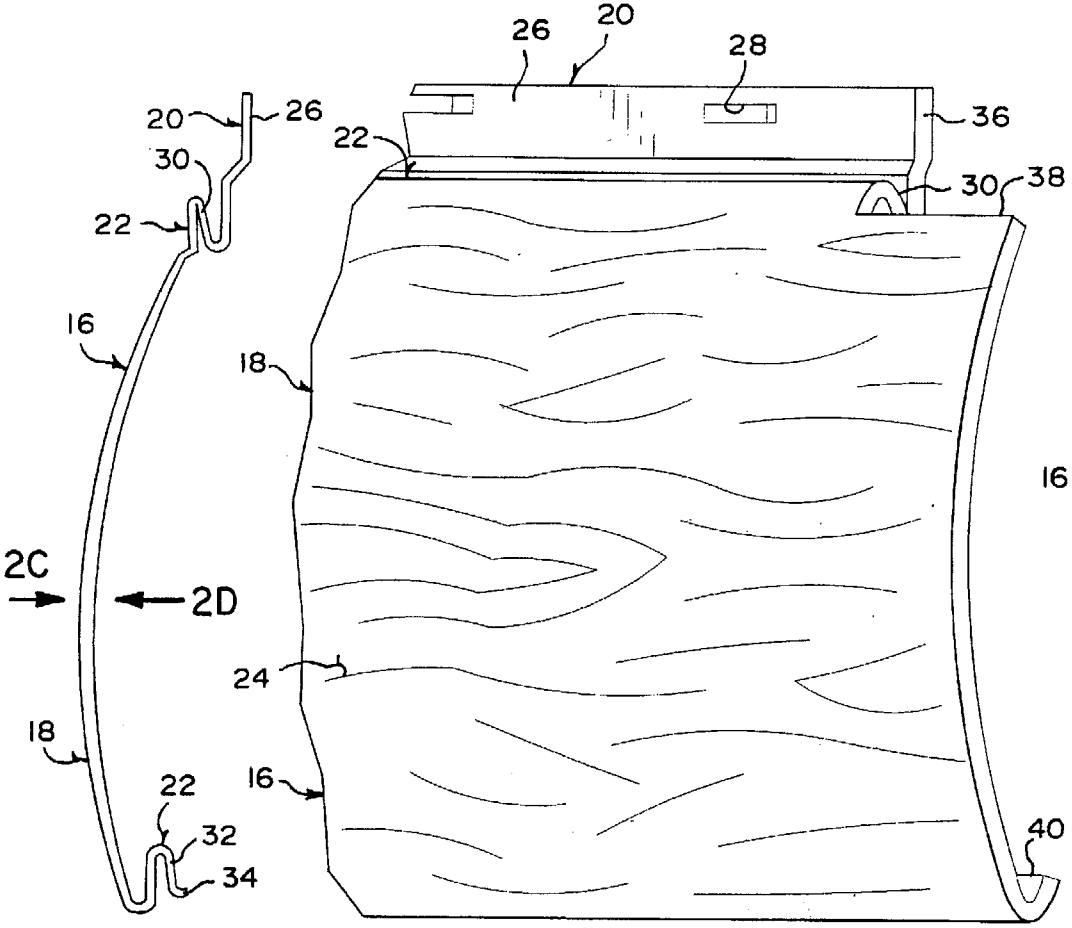
FIG 2C
FIG 2B

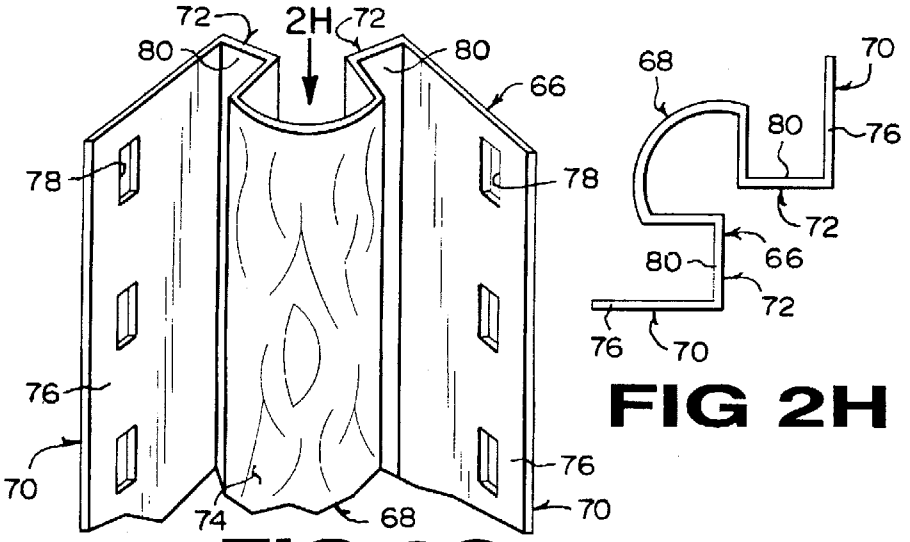
FIG 2H
FIG 2G
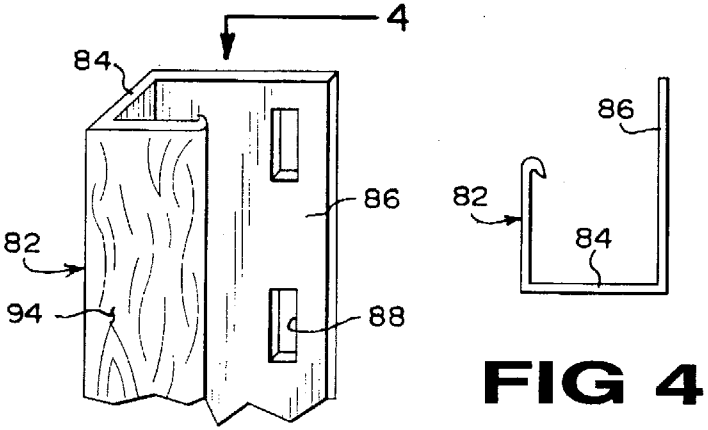
FIG 4
FIG 3
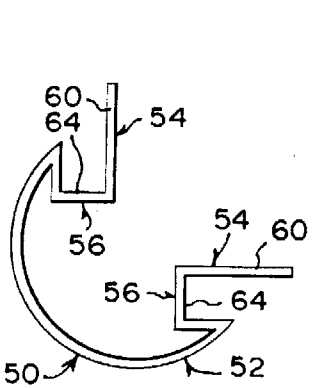
FIG 2F
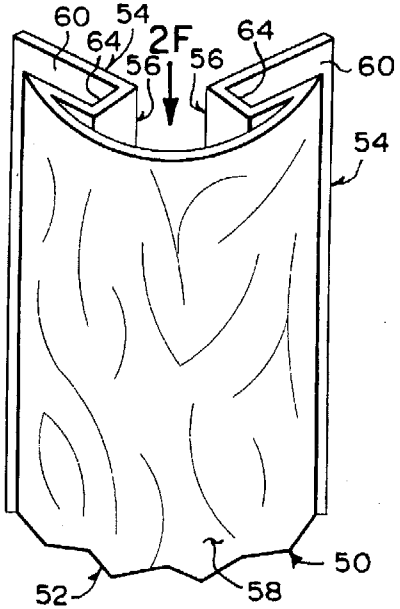
FIG 2E
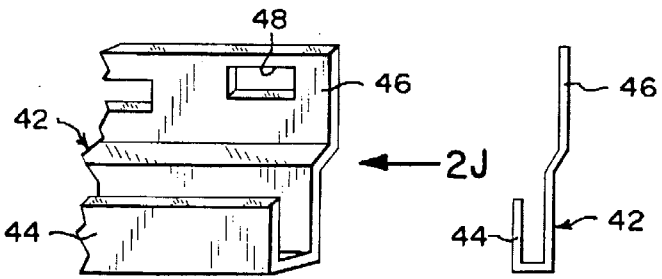
FIG 2J
FIG 2I

VINYL SIDING SYSTEM

BACKGROUND OF THE INVENTION

1. Field of the Invention

The instant invention relates generally to outdoor roof and wall coverings and more specifically it relates to a vinyl siding system.

2. Description of the Prior Art

Numerous outdoor roof and wall coverings have been provided in prior art. For example, U.S. Pat. No. 1,963,583 to Jenkins; U.S. Pat. No 2,126,676 to Thomas; U.S. Pat. No. 5,347,784 to Crick et al. and U.S. Pat. No. 5,423,153 to Woolems et al. all are illustrative of such prior art. While these units may be suitable for the particular purpose to which they address, they would not be as suitable for the purposes of the present invention as heretofore described.

JENKINS, NICHOLAS

METAL ROOFING

U.S. Pat. No. 1,963,583

In metal roofing, sheathing having a tongue projecting therefrom. The tongue has a notch on an under side thereof. Metal shingles have interlocking portions cooperating with the notch to form a joint between the shingles.

THOMAS, FRANK S.

SIDING

U.S. Pat. No. 2,126,676

In a building construction of the class described, the combination with a surface to be covered, of a plurality of sheets of covering material adapted to cover the surface. Each sheet has its lower marginal edge permanently bent backwardly upon the rear face of the sheet forming an upwardly directed groove along that edge of the sheet. Also each sheet has its upper marginal edge permanently bent forwardly upon the front face of the sheet to form a downwardly directed groove along the upper edge of the sheet. Metallic clips are disposed in spaced relation along the upper and lower edges of each sheet. Nails extend through the clips and into the surface to be covered for securing the clips in position. The clips have lower edge portions permanently bent backwardly upon the rear faces of the clips to form upwardly directed grooves along the lower edges of the clips. The sheets are disposed in parallelism so that the lower edge of each sheet overlies the upper edge of the next adjacent sheet. The lower edges of the clips engage in the groove in the lower edges of the sheet. The groove in the upper edges of the sheet engage the grooves in the lower edges of the clip. Seat blocks are interposed between the clip and the surface to be covered. The nails extend through the seat blocks to secure the latter in position on a surface to be covered with the seat blocks serve to space the sheets of covering material from the surface to be covered. Insulating material is confined in the space between the surface to be covered and the sheets of covering material. The seat blocks have lower rabbeted edges. The sheets of covering material adjacent the upper edges thereof have forwardly extended flanges engaging in the rabbeted edges of the seat blocks.

CRICK, DALLAS M.

MOLIERE, ALFRED

DECORATIVE WALL COVERING WITH IMPROVED INTERLOCK AND CORNER CONSTRUCTION

U.S. Pat. No. 5,347,784

A wall covering comprising a plurality of plastic molded panels each having a relatively thin body portion formed with rows of simulated building elements. The panels are mounted on a support surface in a plurality of horizontal courses with a side marginal edge region of one panel overlapping and sealingly engaging an underlying side marginal edge region of the adjacent panel. The underlying side marginal edge region of each panel is formed with a plurality of laterally extending interlock flanges each having a nailing aperture. The overlapping side marginal edge region of the adjacent panel has a plurality of integrally formed hooks for engaging an upper peripheral edge of a respective one of the interlock flanges for positively interlocking the overlapping sides and for maintaining sealing engagement therebetween. A corner molding is provided for receiving respective ends of the panels at a corner in a manner which enhances the aesthetic appearance of the finished installation.

WOOLEMS, BRENT E.

WOOLEMS, PHILIP E.

SIMULATED LOG SIDING FOR BUILDINGS

U.S. Pat. No. 5,423,153

A simulated log siding for a cabin, house or other building is disclosed which can be constructed of tree heartwood, such as oak, or vinyl plastic. In the heartwood species, elongated planks are provided which have an outwardly bowed outer facing surface and a flat inwardly facing surface. Each plank contains a notches inwardly facing lower edge and a rail extending along an upper edge of the outwardly bowed surface. The rail of a lower row of such planks inserts into the rabbet joint of an immediately adjacent upper row of such planks to provide a moisture barrier between adjoining rows. In the vinyl plastic species elongated planks are provided which also have an outwardly bowed outer facing surface. A flat panel is attached along an upper edge of the bowed surface which contains an outwardly projecting, downwardly opening catch channel or member. The base of each plastic plank is flat and contains an upwardly projecting flange which fits into the catch channel of an immediately lower row of such planks to provide an overlapping virtually water tight seal between such rows.

SUMMARY OF THE INVENTION

A primary object of the present invention is to provide a vinyl siding system that will overcome the shortcomings of the prior art devices.

Another object is to provide a vinyl siding system that contains an over locking structure which will keep the panels from coming loose during extension of the panels after being mounted to exterior walls of a building.

An additional object is to provide a vinyl siding system in which each panel contains a low gloss wood grain or hand hewn texture on its face, so that when the panels are mounted to the support surface of the building a simulated log cabin appearance will be created.

A further object is to provide a vinyl siding system that is simple and easy to use.

A still further object is to provide a vinyl siding system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 2B is a further enlarged side view of one round log eight inch panel as indicated by arrow 2B in FIG. 2.

FIG. 2C is a front perspective view taken generally in the direction of arrow 2C in FIG. 2B.

FIG. 2D is a rear perspective view taken generally in the direction of arrow 2D in FIG. 2B.

FIG. 2E is a further enlarged front perspective view of the outside corner post as indicated by arrow 2E in FIG. 2.

FIG. 2F is a top view taken in the direction of arrow 2F in FIG. 2E.

FIG. 2G is a further enlarged front perspective view of the inside corner post as indicated by arrow 2G in FIG. 2.

FIG. 2H is a top view taken in the direction of arrow 2H in FIG. 2G.

FIG. 2I is a further enlarged front perspective view of the starter strip as indicated by arrow 2I in FIG. 2.

FIG. 2J is a side view taken in the direction of arrow 2J in FIG. 2I.

FIG. 3 is an enlarged front perspective view of a J-channel as indicated by arrow 3 in FIG. 1.

FIG. 4 is a top view taken in the direction of arrow 4 in FIG. 3.

Similar reference characters denote corresponding features consistently throughout the attached drawings.

DETAILED DESCRIPTION OF THE PREFERRED EMBODIMENTS

Figure 1:
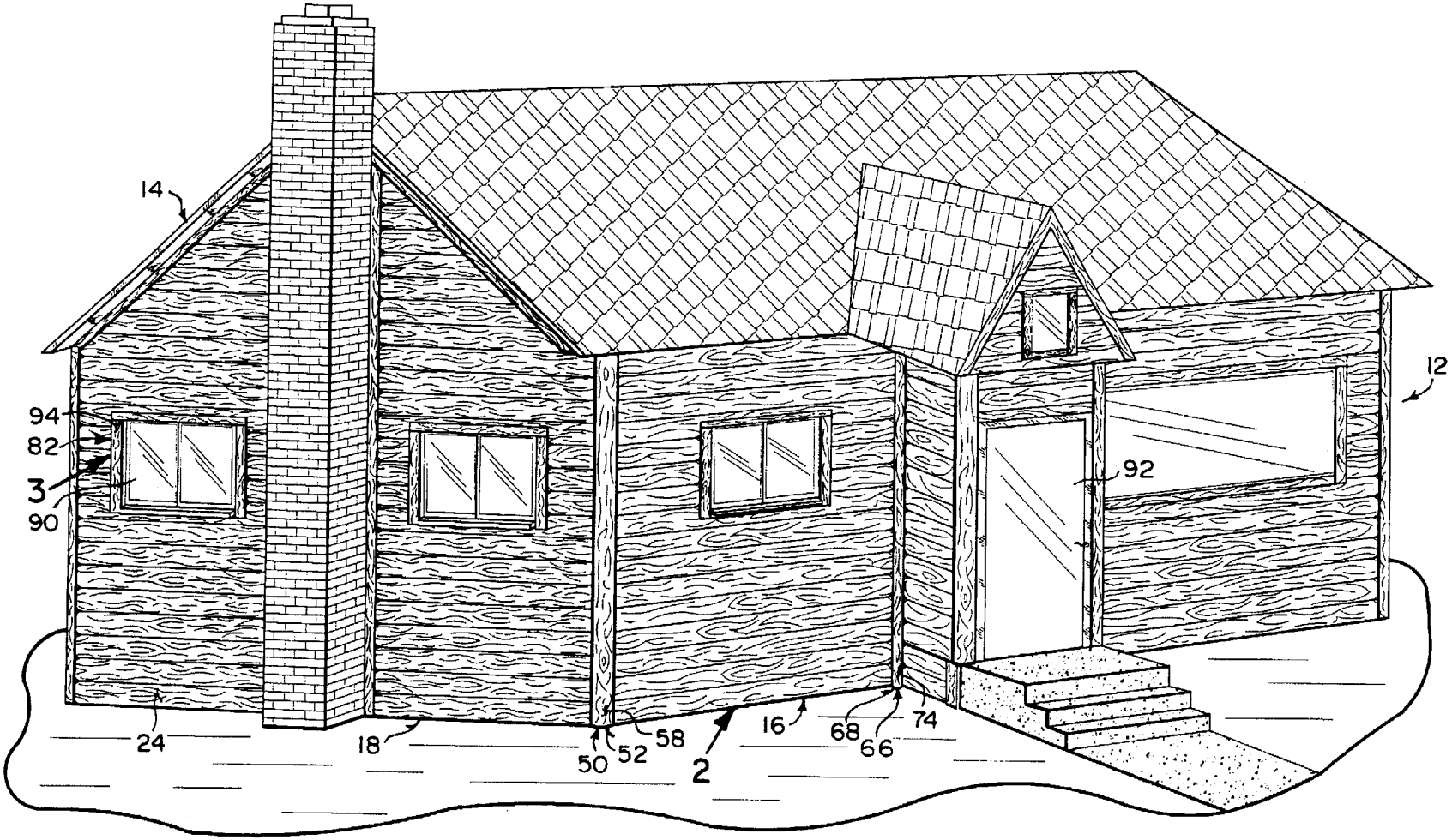
FIG. 1 is a perspective view of a house with the instant invention having a low gloss wood grain texture on its face, installed to the exterior support surface of the housing, to simulate a log cabin appearance.
Figure 2A:
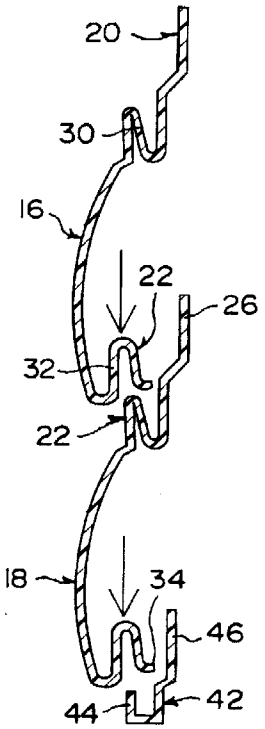
FIG. 2A is an exploded cross sectional view taken along line 2A—2A in FIG. 2.
Figure 2:
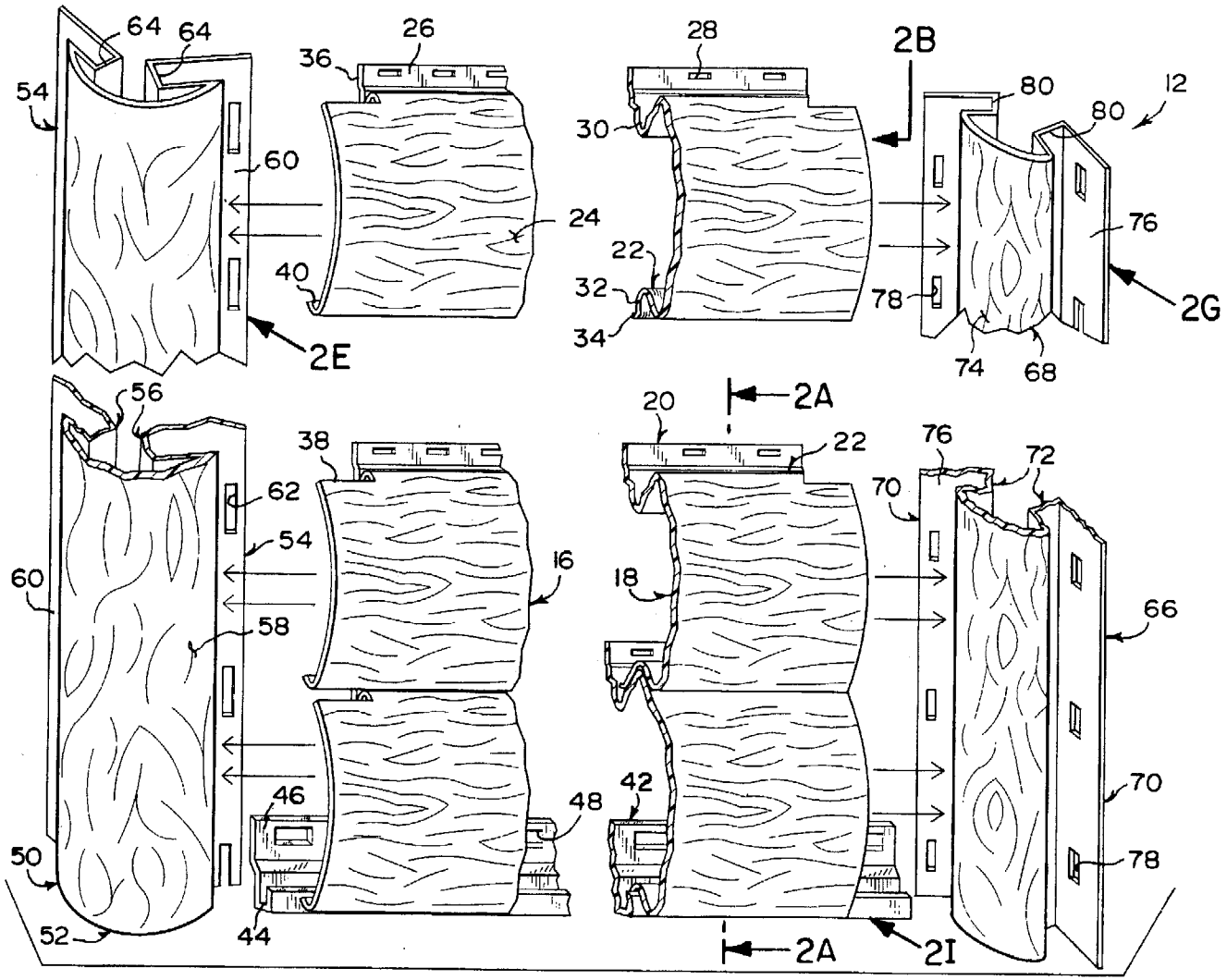
FIG. 2 is an enlarged partly exploded perspective view with parts broken away and in section of the area indicated by arrow 2 in FIG. 1.

Turning now descriptively to the drawings, in which similar reference characters denote similar elements throughout the several views, FIGS. 1 and 2 illustrate a vinyl siding system 12 for the exterior walls of a building 14 which comprises a plurality of panels 16, in which each of the panels 16 has a body portion 18. A structure 20 is for mounting the panels 16 against the exterior walls of the building 14 in horizontal extending rows, so that the panels 16 will be aligned one above another. A facility 22 is for over locking the panels 16 together, when the mounting structure 20 is utilized on the exterior walls of the building 14, so as to keep the panels 16 from coming loose during expansion of the panels 16.

A pattern 24 is formed on a front surface of each body portion 18 of the panels 16. When the panels 16 are secured to the exterior walls of the building 14 by the mounting structure 20, a simulated log cabin appearance will be created.

The mounting structure 20, as best seen in FIGS. 2, 2C, 2D and 10, includes a horizontal flat nail plate 26 extending upwardly and set back from the top of each panel 16. Each flat nail plate 26 has spaced apart nail slots 28 to insure that nails can be driven through the nail slots 28 and into the exterior wall of the building 14. Each flat nail plate 26 will underlie the bottom of the panel 16 directly above.

The over locking facility 22, as best seen in FIGS. 2 to 2D, consists of a horizontal lock groove 30 formed in each panel 16 between the body portion 18 and the flat nail plate 26. A horizontal lock tongue 32 has a turned up edge 34 formed on the bottom of each panel 16 at the rear thereof. The lock tongue 32 will engage with the lock groove 30 of the panel 16 directly below.

Each panel 16 includes the flat nail plate 26, having a cut back 36 on opposite ends. The lock groove 30 has a cut back 38 on opposite ends. The lock tongue 32 has a cut back 40 on opposite ends, to allow for overlapping of the panels 16 in side by side relationships.

Figure 10:
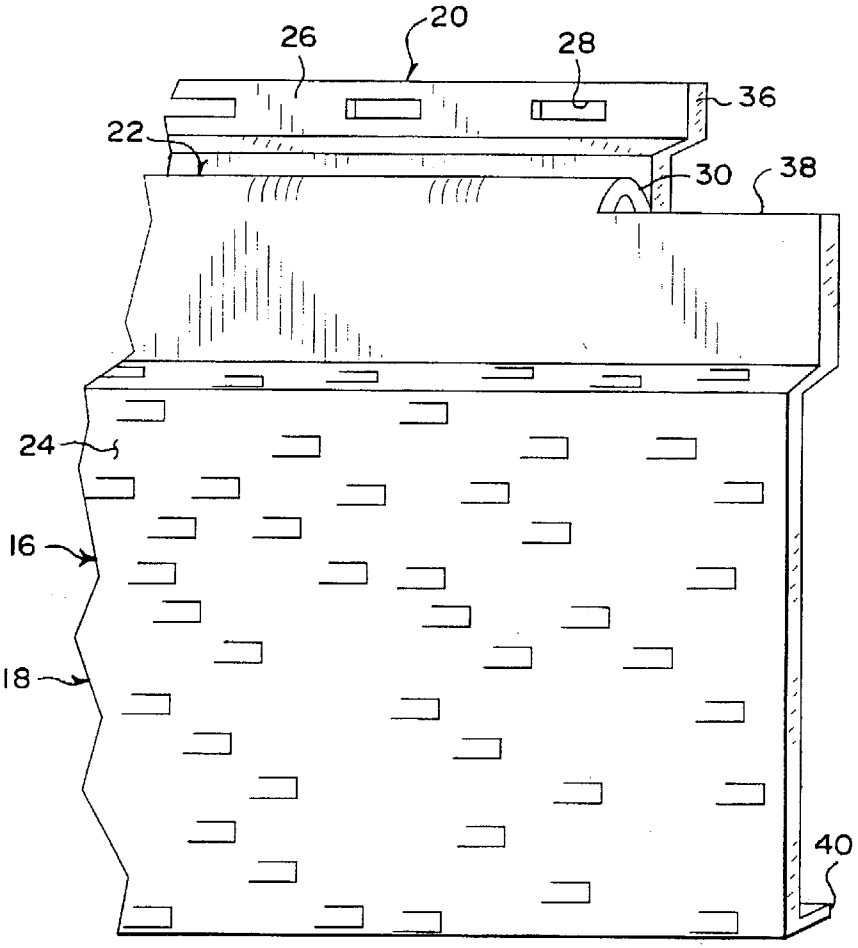
FIG. 10 is a front perspective view taken generally in the direction of arrow 10 in FIG. 9, showing the panel having a low gloss hand hewn texture on its face.

The pattern 24 formed on the front surface of each body portion 18 of the panels 16 can be a low gloss wood grain texture, as shown in FIGS. 1, 2 and 2C. The pattern 24 formed on the front surface of each body portion 18 of the panels 16 can also be a low gloss hand hewn texture, as shown in FIG. 10.

A plurality of starter strips 42 are also provided. Each of the starter strips 42, as shown in FIGS. 2, 2A, 2I and 2J, contains a horizontal U-shaped lock groove 44. A horizontal flat nail plate 46 extends upwardly and is set back from the lock groove 44. The flat nail plate 46 having spaced apart nail slots 48 will insure that nails can be driven through the nail slots 48 and into the exterior wall of the building 14. The lock tongue 32 on the lowest panel 16 will engage with the lock groove 44 of the starter strip 42. The flat nail plate 46 will underlie the bottom of the lowest panel 16.

The vinyl siding system 12 further consists of a plurality of outside corner posts 50. Each of the outside corner posts 50, as best seen in FIGS. 2, 2E and 2F, has a body portion 52. Components 54 are for mounting each outside corner post 50 against an outside corner of the exterior walls of the building 14 in a vertical position. Elements 56 are for engaging the ends of the panels 16 to the outside corner posts 50.

A pattern 58 is formed on a front surface of each body portion 52 of the outside corner posts 50. when the outside corner posts 50 are secured to the outside corners of exterior walls of the building 14 by the mounting components 54, a simulated log cabin appearance will be created.

The mounting component 54 includes a pair of vertical flat nail plates 60. Each flat nail plate 60 extends outwardly at a right angle from an opposite side of each outside corner post 50. Each flat nail plate 60 having spaced apart nail slots 62 will insure that nails can be driven through the nail slots 62, and into the exterior wall at the outside corner of the building 14, whereby each flat nail plate 60 will underlie the ends of the panels 16.

The engaging elements 56 consists of a pair of vertical U-shaped channels 64. Each U-shaped channel 64 is formed in each outside corner post 50 between the body portion 52 and one flat nail plate 60, so that the ends of the panels 16 will fit into the U-shaped channels 64.

The pattern 58 formed on the front surface of each body portion 52 of the outside corner posts 50 can be a low gloss wood grain texture, as shown in FIGS. 1, 2 and 2E. The pattern 58 formed on the front surface of each body portion 52 of the outside corner posts 50 can also be a low gloss hand hewn texture, as is similarly shown in FIG. 10.

The vinyl siding system 12 further contains a plurality of inside corner posts 66. Each of the inside corner posts 66, as best seen in FIGS. 2, 2G and 2H, has a body portion 68. Items 70 are for mounting each inside corner post 66 against an inside corner of the exterior walls of the building 14 in a vertical position. Articles 72 are for engaging the ends of the panels 16 to the inside corner posts 66.

A pattern 74 is formed on a front surface of each body portion 68 of the inside corner posts 66. When the inside corner posts 66 are secured to the inside corners of the exterior walls of the building 14 by the mounting items 70, a simulated log cabin appearance will be created.

The mounting items 70 includes a pair of vertical flat nail plates 76. Each flat nail plate 76 extends inwardly at a right angle from an opposite side of each inside corner post 66. Each flat nail plate 76 having spaced apart nail slots 78 will insure that nails can be driven through the nail slots 78 and into the exterior wall at the inside corner of the building 14, whereby each flat nail plate 76 will underlie the ends of the panels 16.

The engaging articles 72 contain a pair of vertical U-shaped channels 80. Each U-shaped channel 80 is formed in each inside corner post 66 between the body portion 68 and one flat nail plate 76, so that the ends of the panels 16 will fit into the U-shaped channels 80.

The pattern 74 formed on the front surface of each body portion 68 of the inside corner posts 66 can be a low gloss wood grain texture, as shown in FIGS. 1, 2 and 2G. The pattern 74 formed on the front surface of each body portion 68 of the inside corner post 66 can also be a low gloss hand hewn texture, as similarly shown in FIG. 10.

The vinyl siding system 12 further consists of a plurality of J-shaped channel members 82, as best shown in FIGS. 3 and 4. Each of the J-shaped channel members 82 contains a U-shaped conduit 84. A flat nail plate 86 extends outwardly from a back portion of the conduit 84. The flat nail plate 86 having spaced apart nails slots 88, will insure that nails can be driven through the nail slots 88 and into the exterior wall of the building 14 about a window 90 and door 92 thereof. The ends of the panels 16 will engage with the U-shaped conduit 84 of the J-shaped channel member 82, while the flat nail plate 86 will underlie the ends of the panels 16.

A pattern 94 is formed on a front surface of each U-shaped conduit 84 of the J-shaped channel members 82. When the J-shaped channel members 82 are secured to the exterior walls of the building 14 about the windows 90 and doors 92 by the flat nail plates 86, a simulated log cabin appearance will be created.

The pattern 94 formed on the front surface of each U-shaped conduit 84 of the J-shaped channel members 82 can be a low gloss wood grain texture, as shown in FIGS. 1 and 3. The pattern 94 formed on the front surface of each U-shaped conduit 84 of the J-shaped channel members 82 can also be a low gloss hand hewn texture, as similarly shown in FIG. 10.

Figure 8:
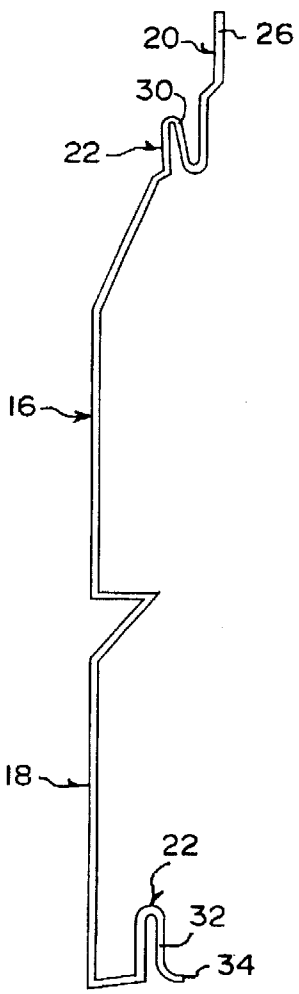
FIG. 8 is a side view of a double 5 dutch lap ten inch panel with the locking structure built therein.
Figure 7:
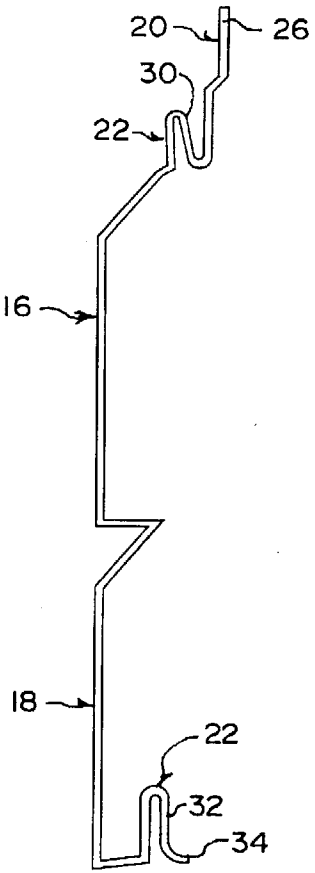
FIG. 7 is a side view of a double 4 dutch lap eight inch panel with the locking structure built therein.
Figure 6:
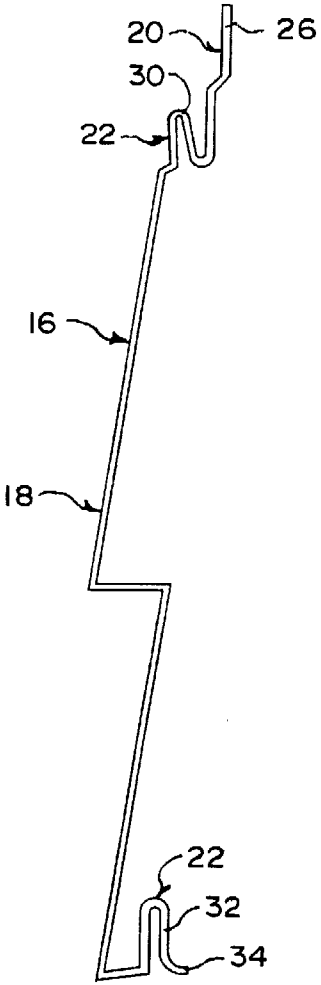
FIG. 6 is a side view of a standard double 5 ten inch panel with the locking structure built therein.
Figure 5:
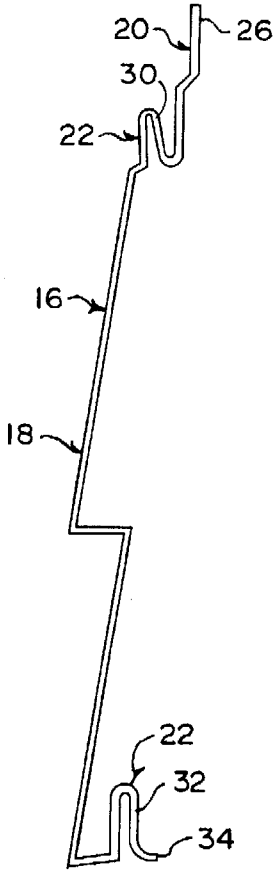
FIG. 5 is a side view of a standard double 4 eight inch panel with the locking structure built therein.
Figure 9:
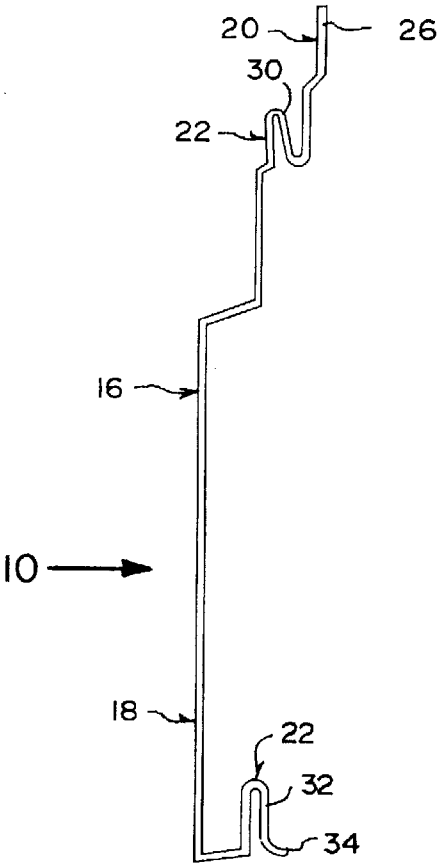
FIG. 9 is a side view of a hewn log with chink design eight inch panel with the locking structure built therein.

Each panel 16 can be a round log eight inch type, as shown in FIGS. 1 through 2D, a standard double 4 eight inch type, as shown in FIG. 5 and a standard double 5 ten inch type, as shown in FIG. 6. Each panel 16 can also be a double 4 dutch lap eight inch type, as shown in FIG. 7, a double 5 dutch lap ten inch type, as shown in FIG. 8 and a hewn log with chink design eight inch type, as shown in FIGS. 9 and 10.

LIST OF REFERENCE NUMBERS

12 vinyl siding system
14 building
16 panel of 12
18 body portion of 16
20 mounting structure of 16
22 over locking facility of 16
24 pattern on 18
26 flat nail plate of 20
28 nail slot in 26
30 lock groove of 22
32 lock tongue of 22
34 turned up edge of 32
36 cut back of 26
38 cut back of 30
40 cut back of 32
42 starter strip of 12
44 lock groove in 42
46 flat nail plate in 42
48 nail slot in 46
50 outside corner post of 12
52 body portion of 50
54 mounting component of 50
56 engaging element of 50
58 pattern on 52
60 flat nail plate of 54
62 nail slot in 60
64 U-shaped channel of 56
66 inside corner post of 12
68 body portion of 66
70 mounting item of 66
72 engaging article of 66
74 pattern on 68
76 flat nail plate of 70
78 nail slot in 76
80 U-shaped channel of 72
82 J-shaped channel member
84 U-shaped conduit of 82
86 flat nail plate of 82
88 nail slot in 86
90 window of 14
92 door of 14
94 pattern on 84

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A vinyl siding system for the exterior walls of a building which comprises:

a) a plurality of panels in which each of said panels has a body portion;

b) means for mounting said panels in horizontal extending rows, so that said panels will be aligned one above another;

c) means for overlocking said panels together, when said mounting means is adapted to be utilized on exterior walls of a building, so as to keep said panels from coming loose during expansion of said panels;

d) a pattern formed on a front surface of each said body portion of said panels, so that when said panels are secured to exterior walls of a building by said mounting means a simulated log cabin appearance will be created; and e) plurality of starter strips, in which each of said starter strips contains:

i) a horizontal U-shaped lock groove; and ii) a horizontal flat nail plate extending upwardly and set back from said lock groove, in which said flat nail plate having spaced apart nail slots will insure that nails can be driven through said nail slots and into an exterior wall of a building, so that said lock tongue on a lowest panel will engage with said lock groove of said starter strip, while said flat nail plate will underlie a bottom portion of said lowest panel.

2. A vinyl siding system for exterior walls of a building which comprises:

a) a plurality of panels, each of which has a body portion and end portions;

b) a plurality of outside corner posts, in which each of said outside corner posts has a body portion;

c) means for mounting each said outside corner post against an outside corner in a vertical position;

d) means for mounting said panels against exterior walls in horizontal extending rows, so that said panels will be aligned one above another, said mounting means being a pair of vertical flat nail plates, each said flat nail plate extending outwardly at a right angle from an opposite side of each said outside corner post, in which each said flat nail plate having spaced apart nail slots will insure that nails can be driven through said nail slots and into an exterior wall at an outside corner of a building, whereby each said flat nail plate will underlie the ends of said panels;

e) means for engaging the ends of said panels to said outside corner posts, said engaging means being a pair of vertical U-shaped channels, in which each said U-shaped channels is formed in each said outside corner post between said body portion and one said flat nail plate, so that the ends of said panels will fit into said U-shaped channels;

f) means for overlocking said panels together, when said intended to be mounting means is utilized on exterior walls of a building, so as to keep said panels from coming loose during expansion of said panels; and g) a pattern formed on a front surface of each said body portion of said panels and said outside corner posts, so that when said panels and said outside corner posts are intended to be secured to exterior walls of a building, a simulated log cabin appearance will be created.

3. A vinyl siding system for exterior walls of a building which Comprises:

a) a plurality of panels, each of which has a body portion and end portions;

b) a plurality of inside comer posts, in which each of said inside corner posts has a body portion;

c) means for mounting each said inside corner post in a vertical position;

d) means for mounting said panels in horizontal extending rows, so that said panels will be aligned one above another, said mounting means being a pair of vertical flat nail plates, each said flat nail plate extending inwardly at a right angle from an opposite side of each said inside corner post, in which each said flat nail plate having spaced apart nail slots will insure that nails can be driven through said nail slots and into an inside corner whereby each said flat nail plate will underlie the ends of said panels;

e) means for engaging the ends of said panels to said inside corner posts, said engaging means being a pair of vertical U-shaped channels, in which each said U-shaped channel is formed in each said inside corner post between said body portion and one said flat nail plate, so that the ends of said panels will fit into said U-shaped channels;

f) means for overlocking said panels together, when said mounting means is intended to be utilized on exterior walls of a building, so as to keep said panels from coming loose during expansion of said panels; and g) a pattern formed on a front surface of each said body portion of said panels and said inside corner posts, so that when said panels and said inside corner posts are secured to exterior walls of a building, a simulated log cabin appearance will be created.

4. A vinyl siding system for exterior walls of a building which comprises:

a) a plurality of panels, each of which has a body b) means for mounting said panels against exterior walls of a building in horizontal extending rows, so that said panels will be aligned one above another;

c) means for overlocking said panels together, when said mounting means is intended to be utilized on exterior walls of a building, so as to keep said panels from coming loose during expansion of said panels;

d) a pattern formed on a front surface of each said body portion of said panels, so that when said panels are intended to be secured to exterior walls of a building by said mounting means, a simulated log cabin appearance will be created; and e) a plurality of J-shaped channel members, in which each of said J-shaped channel members contains:

i) a U-shaped conduit;

ii) a flat nail plate extending outwardly from a back portion of said conduit, in which said flat nail plate having spaced apart nail slots will insure that nails can be driven through said nail slots about a window and door thereof, so that the ends of said panels will engage with said U-shaped conduit of said J-shaped channel member, while said flat nail plate will underlie the ends of said panels; and iii) a pattern formed on a front surface of each said U-shaped conduit of said J-shaped channel members, so that when said J-shaped channel members are intended to be secured to exterior walls of a building about the windows and doors by said flat nail plates, a simulated log cabin appearance will be created.

5. A vinyl siding system as recited in claim 4, wherein said pattern formed on said front surface of each said U-shaped conduit of said J-shaped channel members is selected from the group consisting of a low gloss wood grain texture and a low gloss hand hewn texture.

6. A vinyl siding system for exterior walls of a building which comprises:.

a) a plurality of panels in which each of said panels has a body portion;

b) means for mounting said panels in horizontal extending rows, so that said panels will be aligned one above another such that each said panel has top and bottom edges, side ends, and front and rear surfaces, wherein said mounting means is a horizontal flat nail plate extending upwardly and set back from the top of each said panel, each said flat nail plate having spaced apart nail slots which will insure that nails are driven through said nail slots whereby each said flat nail plate will underlie the bottom of said panel directly above;

c) means for over locking said panels together, when said mounting means is intended to be utilized on exterior walls of a building, so as to keep said panels from coming loose during expansion of said panels, wherein said over locking means comprises a horizontal lock groove formed in each said panel between said body portion and said flat nail plate and a horizontal lock tongue having a turned up edge formed on the bottom of each said panel at the rear thereof, whereby said lock tongue will engage with said lock groove of said panel directly below;

d) a pattern formed on a front surface of each said body portion of said panels, so that when said panels are intended to be secured to exterior walls of a building by said mounting means a simulated log cabin appearance will be created; and e) each said panel consisting of said flat nail plate having a cut back on opposite ends, said lock groove having a cut back on opposite ends and said lock tongue having a cut back on opposite ends, to allow for overlapping of said panels in side by side relationships.

7. A vinyl siding system as recited in claim 6, wherein said pattern formed on said front surface of each said body portion of said panels is selected from the group consisting of a low gloss wood grain texture and a low gloss hand hewn texture.

8. A vinyl siding system as recited in claim 7, further including a plurality of starter strips, in which each of said starter strips contains:

a) a horizontal U-shaped lock groove; and b) a horizontal flat nail plate extending upwardly and set back from said lock groove, in which said flat nail plate having spaced apart nail slots will insure that nails can be driven through said nail slots and into the exterior wall of the building, so that said lock tongue on said lowest panel will engage with said lock groove of said starter strip, while said flat nail plate will underlie the bottom of said lowest panel.

9. A vinyl siding system as recited in claim 8, further including:

a) a plurality of outside corner posts, in which each of said outside corner posts has a body portion;

b) means for mounting each said outside corner post against an outside corner of the exterior walls of the building in a vertical position;

c) means for engaging the ends of said panels to said outside corner posts; and d) a pattern formed on a front surface of each said body portion of said outside corner posts, so that when said outside corner posts are secured to the outside corners of exterior walls of the building by said mounting means, a simulated log cabin appearance will be created.

10. A vinyl siding system as recited in claim 9, further including:

a) said mounting means being a pair of vertical flat nail plates, each said flat nail plate extending outwardly at a right angle from an opposite side of each said outside corner post, in which each said flat nail plate having spaced apart nail slots will insure that nails can be driven through said nail slots and into the exterior wall at the outside corner of the building, whereby each said flat nail plate will underlie the ends of said panels; and b) said engaging means being a pair of vertical U-shaped channels, in which each said U-shaped channel is formed in each said outside corner post between said body portion and one said flat nail plate, so that the ends of said panels will fit into said U-shaped channels.

11. A vinyl siding system as recited in claim 10, wherein said pattern formed on said front surface of each said body portion of said outside corner posts is selected from the group consisting of a low gloss wood grain texture and a low gloss hand hewn texture.

12. A vinyl siding system as recited in claim 11, further including:

a) a plurality of inside corner posts in which each of said inside corner posts has a body portion;

b) means for mounting each said inside corner post against an inside corner of the exterior walls of the building in a vertical position;

c) means for engaging the ends of said panels to said inside corner posts; and d) a pattern formed on a front surface of each said body portion of said inside corner posts, so that when said inside corner posts are secured to the inside corners of the exterior walls of the building by said mounting means, a simulated log cabin appearance will be created.

13. A vinyl siding system as recited in claim 12, further including:

a) said mounting means being a pair of vertical flat nail plates, each said flat nail plate extending inwardly at a right angle from an opposite side of each said inside corner post, in which each said flat nail plate having spaced apart nail slots will insure that nails can be driven through said nail slots and into the exterior wall at the inside corner of the building, whereby each said flat nail plate will underlie the ends of said panels; and b) said engaging means being a pair of vertical U-shaped channels, in which each said U-shaped channel is formed in each said inside corner post between said body portion and one said flat nail plate, so that the ends of said panels will fit into said U-shaped channels.

14. A vinyl siding system as recited in claim 13, wherein said pattern formed on said front surface of each said body portion of said inside corner posts is selected from the group consisting of a low gloss wood grain texture and a low gloss hand hewn texture.

15. A vinyl siding system as recited in claim 14, further including a plurality of J-shaped channel members, in which each of said J-shaped channel members contains:

a) a U-shaped conduit;

b) a flat nail plate extending outwardly from a back portion of said conduit, in which said flat nail plate having spaced apart nail slots will insure that nails can be driven through said nail slots and into the exterior wall of the building about a window and door thereof, so that the ends of said panels will engage with said U-shaped conduit of said J-shaped channel member, while said flat nail plate will underlie the ends of said panels; and c) a pattern formed on a front surface of each said U-shaped conduit of said J-shaped channel members, so that when said J-shaped channel members are secured to the exterior walls of the building about the windows and doors by said flat nail plates, a simulated log cabin appearance will be created.

16. A vinyl siding system as recited in claim 15, wherein said pattern formed on said front surface of each said U-shaped conduit of said J-shaped channel members is selected from the group consisting of a low gloss wood grain texture and a low gloss hand hewn texture.

17. A vinyl siding system as recited in claim 16, wherein each said panel is selected from the group consisting of a round log eight inch type, a standard double 4 eight inch type, a standard double 5 ten inch type, a double 4 dutch lap eight inch type, a double 5 dutch lap ten inch type and a hewn log with chink design eight inch type.

* * * * *